US009966001B2

(12) United States Patent
Gu et al.

(10) Patent No.: US 9,966,001 B2
(45) Date of Patent: May 8, 2018

(54) PIXEL, ORGANIC LIGHT EMITTING DISPLAY DEVICE INCLUDING PIXEL, AND METHOD OF DRIVING ORGANIC LIGHT EMITTING DISPLAY DEVICE

(71) Applicant: Samsung Display Co., Ltd., Yongin-si, Gyeonggi-do (KR)

(72) Inventors: Bon Seog Gu, Yongin-si (KR); Jong Soo Kim, Yongin-si (KR); Myung Ho Lee, Yongin-si (KR)

(73) Assignee: Samsung Display Co., Ltd. (KR)

( * ) Notice: Subject to any disclaimer, the term of this patent is extended or adjusted under 35 U.S.C. 154(b) by 9 days.

(21) Appl. No.: 15/078,863

(22) Filed: Mar. 23, 2016

(65) Prior Publication Data

US 2017/0032736 A1 Feb. 2, 2017

(30) Foreign Application Priority Data

Jul. 27, 2015 (KR) ..... 10-2015-0106085

(51) Int. Cl.
*G09G 3/3208* (2016.01)

(52) U.S. Cl.
CPC ... *G09G 3/3208* (2013.01); *G09G 2300/0439* (2013.01); *G09G 2300/0465* (2013.01); *G09G 2310/08* (2013.01)

(58) Field of Classification Search
None
See application file for complete search history.

(56) References Cited

U.S. PATENT DOCUMENTS

2004/0239839 A1 12/2004 Hong
2006/0139257 A1* 6/2006 Kwak ..... G09G 3/3233 345/76
2014/0313242 A1 10/2014 Kaplan et al.
2016/0012779 A1 1/2016 Gu et al.
2016/0104436 A1 4/2016 Gu et al.
2016/0181337 A1 6/2016 Gu et al.

FOREIGN PATENT DOCUMENTS

KR 10-2004-0103997 A 12/2004
KR 10-1252089 B1 4/2013
KR 10-2014-0124610 A 10/2014
KR 10-2016-0008706 1/2016
KR 10-2016-0043224 4/2016
KR 10-2016-0075891 6/2016

* cited by examiner

*Primary Examiner* — Kenneth Bukowski
(74) *Attorney, Agent, or Firm* — Innovation Counsel LLP

(57) ABSTRACT

A pixel set may include the following elements: a first diode for emitting first light of first color in a first time period; a second diode for emitting second light of second color in a second time period not overlapping the first time period; a first driving transistor for controlling electrical connection between a first power supply line and the first diode; a second driving transistor for controlling electrical connection between a second power supply line and the second diode; and a data transistor for transmitting a data voltage to a gate electrode of the first driving transistor and a gate electrode of the second driving transistor in response to a scan signal.

14 Claims, 3 Drawing Sheets

PIXEL, ORGANIC LIGHT EMITTING DISPLAY DEVICE INCLUDING PIXEL, AND METHOD OF DRIVING ORGANIC LIGHT EMITTING DISPLAY DEVICE

CROSS-REFERENCE TO RELATED APPLICATION

This application claims priority to and the benefit of Korean Patent Application No. 10-2015-0106085, filed on Jul. 27, 2015, in the Korean Intellectual Property Office; the entire contents of the Korean Patent Application are incorporated herein by reference.

BACKGROUND

1. Field

The technical field relates to a pixel, an organic light emitting display device including the pixel, and a method of driving the organic light emitting display device.

2. Description of the Related Art

Modern display devices include liquid crystal display devices, field emission display devices, plasma display panel devices, and organic light emitting display devices. A display device may include pixels that collectively display an image according to a set of input signals.

SUMMARY

An embodiment of the present invention relates to a pixel in which an area of a pixel circuit is reduced by two driving transistors sharing a storage capacitor and a transistor, an organic light emitting display device including the pixel, and a method of driving the organic light emitting display device.

Another embodiment of the present invention relates to a pixel in which an area of a pixel circuit is reduced by two driving transistors respectively receiving power sources from power source supply lines to which different power sources are supplied and a driving circuit not requiring an additional transistor, an organic light emitting display device including the pixel, and a method of driving the organic light emitting display device. A pixel according to an embodiment may include the following elements: a first organic light emitting diode (OLED) configured to emit first light having a first wavelength; a second organic light emitting diode configured to emit second light having a second wavelength different from the first wavelength; a first driving transistor having a first electrode electrically connected to a first power source supply line, having a second electrode electrically connected to an anode of the first organic light emitting diode, and having a gate electrode electrically connected to a first node; a second driving transistor having a first electrode electrically connected to a second power source supply line, having a second electrode electrically connected to an anode of the second organic light emitting diode, and having a gate electrode electrically connected to the first node; a first transistor (i.e., a first data transistor) having a first electrode electrically connected to a data line, having a second electrode electrically connected to the first node, and having a gate electrode electrically connected to a scan line; and a storage capacitor having one end electrically connected to the first node and having another end to which a sustain voltage is supplied. A period in which the first organic light emitting diode emits the first light does not overlap a period in which the second organic light emitting diode emits the second light.

Cathodes of the first organic light emitting diode and the second organic light emitting diode may be electrically connected to a third power source supply line, which may be a ground voltage supply line. The first organic light emitting diode emits the first light when a level of a voltage supplied to the first power source supply line is a first level, and the second organic light emitting diode emits light when a level of a voltage supplied to the second power source supply line is the first level. The first level is higher than a level of a voltage supplied to the third power source supply line.

The color of the first light and the color of the second light may not complement each other.

The pixel may further include the following elements: a second transistor (i.e., a first sensing transistor) having a first electrode electrically connected to the anode of the first organic light emitting diode, having a second electrode electrically connected to a first sensing line, and having a gate electrode electrically connected to a sensing signal supply line; and a third transistor (i.e., a second sensing transistor) having a first electrode electrically connected to the anode of the second organic light emitting diode, having a second electrode electrically connected to a second sensing line, and having a gate electrode electrically connected to the sensing signal supply line.

An organic light emitting display device may include the above-described pixel. The organic light emitting display device may include the following elements: a display panel including pixels; first power source supply lines configured to transmit a first power source (i.e., a first power supply voltage) to the pixels; second power source supply lines configured to transmit a second power source (i.e., a second power supply voltage) to the pixels; data lines configured to transmit data voltages to the pixels; scan lines configured to transmit scan signals to the pixels; a display panel driver configured to drive the display panel by generating the data voltages and supplying the generated data voltages to the data lines and by generating the scan signals and supplying the generated scan signals to the scan lines; and a power source supplier (i.e., a power supplier) configured to generate the first power source and the second power source and to supply the generated first and second power sources to the first power source supply lines and the second power source supply lines, respectively. Each pixel may include a first organic light emitting diode, a second organic light emitting diode, a first driving transistor having a first electrode electrically connected to one of the first power source supply lines, having a second electrode electrically connected to an anode of the first organic light emitting diode, and having a gate electrode electrically connected to a first node, a second driving transistor having a first electrode electrically connected to one of the second power source supply lines, having a second electrode electrically connected to an anode of the second organic light emitting diode, and having a gate electrode electrically connected to the first node, a first transistor having a first electrically connected to one of the data lines, having a second electrode electrically connected to the first node, and having a gate electrode electrically connected to one of the scan lines, and a storage capacitor having one end electrically connected to the first node and having other end to which a sustain voltage is supplied. Cathodes of the first organic light emitting diode and the second organic light emitting diode are electrically connected to third power source supply line. A period in which the first organic light emitting diode emits light does not overlap a period in which the second organic light emitting diode emits light.

The pixels may include a first pixel and a second pixel adjacent to the first pixel. A first organic light emitting diode of the first pixel emits first light having a first wavelength. A first organic light emitting diode of the second pixel emits second light having a second wavelength different from the first wavelength. Second organic light emitting diodes of the first pixel and the second pixel emit third light components having a third wavelength different from the first wavelength and the second wavelength.

The sum of the color of the first light and the color of the second light may complement the color of the third light.

The second wavelength may be shorter than the first wavelength and may be longer than the third wavelength.

The organic light emitting display device may further include first sensing lines, second sensing lines, and sensing signal supply lines. Each pixel may further include the following elements a second transistor having a first electrode electrically connected to the anode of the first organic light emitting diode, having a second electrode electrically connected to one of the first sensing lines, and having a gate electrode electrically connected to one of the sensing signal supply lines and a third transistor having a first electrode electrically connected to the anode of the second organic light emitting diode, having a second electrode electrically connected to one of the second sensing lines, and having a gate electrode electrically connected to one of the sensing signal supply lines.

A method of driving the organic light emitting display device according to an embodiment may include the following steps: supplying first data voltages corresponding to the first organic light emitting diodes among the data voltages to the first nodes; setting a voltage level of the first power source as a first level so that the first organic light emitting diodes emit a first light components; supplying second data voltages corresponding to the second organic light emitting diodes among the data voltages to the first nodes; and setting a voltage level of the second power source as the first level so that the second organic light emitting diodes emit a second light components. The organic light emitting display device may include one or more of the above-described elements. a display panel including pixels, first power source supply lines configured to transmit a first power source to the pixels, second power source supply lines configured to transmit a second power source to the pixels, data lines configured to transmit data voltages to the pixels, and scan lines configured to transmit scan signals to the pixels, a display panel driver configured to drive the display panel by generating the data voltages and supplying the generated data voltages to the data lines and by generating the scan signals and supplying the generated scan signals to the scan lines, and a power source supplier configured to generate the first power source and the second power source and to supply the generated first and second power sources to the first power source supply lines and the second power source supply lines, respectively. Each pixel includes a first organic light emitting diode, a second organic light emitting diode, a first driving transistor having a first electrode electrically connected to one of the first power source supply lines, having a second electrode electrically connected to an anode of the first organic light emitting diode, and having a gate electrode electrically connected to a first node, a second driving transistor having a first electrode electrically connected to one of the second power source supply lines, having a second electrode electrically connected to an anode of the second organic light emitting diode, and having a gate electrode electrically connected to the first node, a first transistor having a first electrode electrically connected to one of the data lines, having a second electrode electrically connected to the first node, and having a gate electrode electrically connected to one of the scan lines, and a storage capacitor having one end electrically connected to the first node and having a sustain voltage supplied to the other end. For the supplying of first data voltages corresponding to the first organic light emitting diodes among the data voltages to the first nodes, a threshold voltage of the first driving transistor is compensated for values of the first data voltages. For the supplying of second data voltages corresponding to the second organic light emitting diodes among the data voltages to the first nodes, a threshold voltage of the second driving transistor is compensated for values of the second data voltages.

The pixels may include a first pixel and a second pixel adjacent to the first pixel. In the setting of a voltage level of the first power source as a first level so that the first organic light emitting diodes emit the first light set, a first organic light emitting diode of the first pixel emits first light having a first wavelength, and a first organic light emitting diode of the second pixel emits second light having a second wavelength different from the first wavelength. In the setting of a voltage level of the second power source as the first level so that the second organic light emitting diodes emit the second light set, second organic light emitting diodes of the first pixel and the second pixel emit third light having a third wavelength different from the first wavelength and the second wavelength. The sum of the color of the first light and the color of the second light can complement the color of the third light.

The second wavelength is shorter than the first wavelength and is longer than the third wavelength.

The organic light emitting display device further includes first sensing lines, second sensing lines, and sensing signal supply lines. Each pixel further includes the following elements: a second transistor having a first electrode electrically connected to the anode of the first organic light emitting diode, having a second electrode electrically connected to one of the first sensing lines, and having a gate electrode electrically connected to one of the sensing signal supply line; and a third transistor having a first electrode electrically connected to the anode of the second organic light emitting diode, having a second electrode electrically connected to one of the second sensing lines, and having a gate electrode electrically connected to the sensing signal supply lines. In at least a part of the supplying of first data voltages corresponding to the first organic light emitting diodes among the data voltages to the first nodes and the supplying of second data voltages corresponding to the second organic light emitting diodes among the data voltages to the first nodes, at least one of the second transistor and the third transistor is turned on.

DETAILED DESCRIPTION

Figure 1:
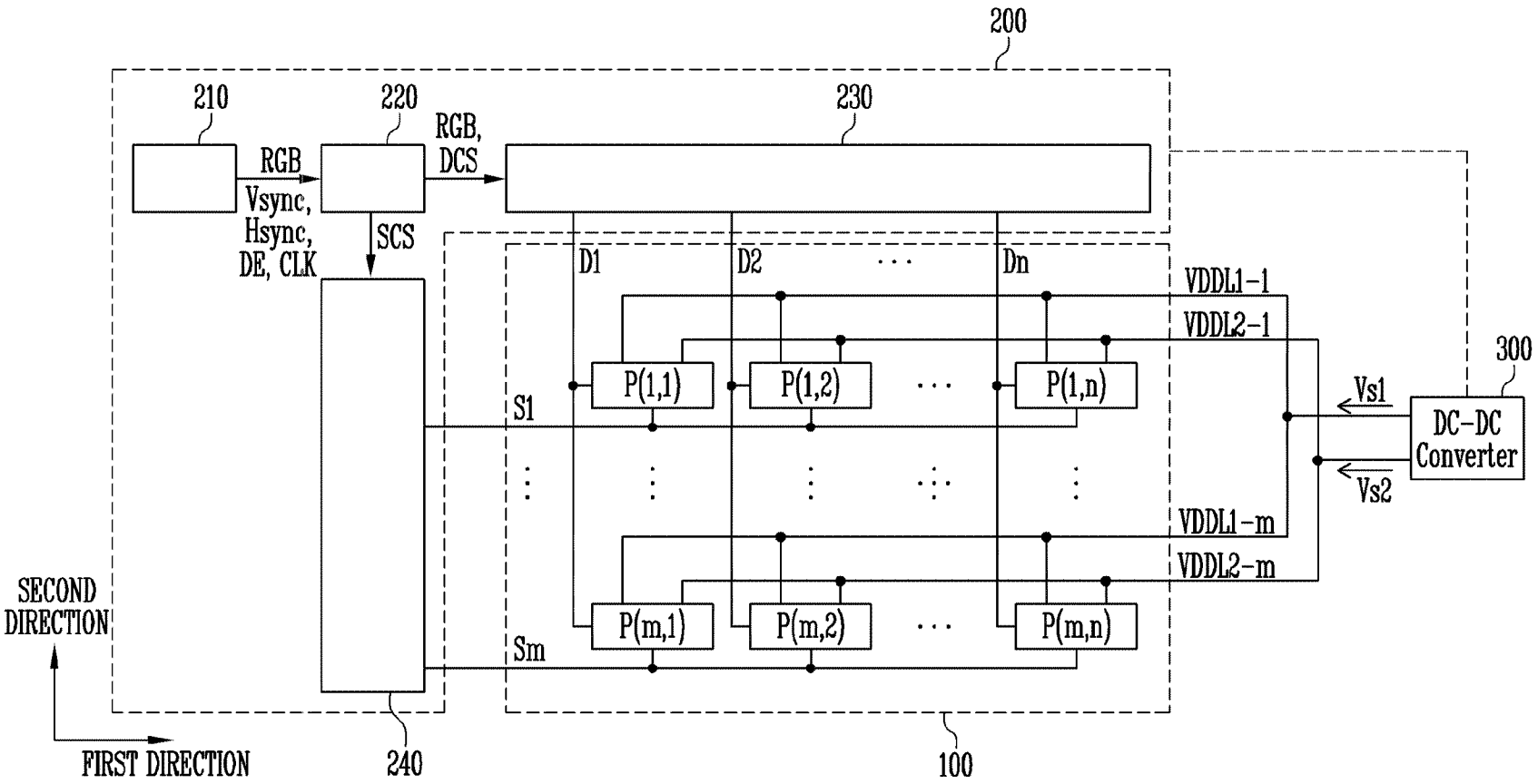
FIG. 1 is a schematic diagram that illustrates elements of a display device, e.g., an organic light emitting display device, according to an embodiment.

Embodiments are described in detail with reference to the accompanying drawings. Like reference numerals may refer to like elements in this application.

Although the terms "first", "second", etc. may be used herein to describe various elements, these elements should not be limited by these terms. These terms may be used to distinguish one element from another element. Thus, a first element recited in this application may be termed a second element without departing from embodiments. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

If a first element (such as a layer, film, region, or substrate) is referred to as being "on", "neighboring", "connected to", or "coupled with" a second element, then the first element can be directly on, directly neighboring, directly connected to, or directly coupled with the second element, or an intervening element may also be present between the first element and the second element. If a first element is referred to as being "directly on", "directly neighboring", "directly connected to", or "directed coupled with" a second element, then no intended intervening element (except environmental elements such as air) may be provided between the first element and the second element.

Spatially relative terms, such as "beneath", "below", "lower", "above", "upper", and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations), and the spatially relative descriptors used herein should be interpreted accordingly.

The terminology used herein is for the purpose of describing particular embodiments and is not intended to limit the embodiments. As used herein, the singular forms, "a", "an", and "the" may indicate plural forms as well, unless the context clearly indicates otherwise. The terms "includes" and/or "including", when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as commonly understood by one of ordinary skill in the art. Terms, such as those defined in commonly used dictionaries, should be interpreted as having meanings that are consistent with their meanings in the context of the relevant art and should not be interpreted in an idealized or overly formal sense unless expressly so defined herein.

The term "connect" may mean "electrically connect". The term "insulate" may mean "electrically insulate". The term "conductive" may mean "electrically conductive". The term "electrically connected" may mean "electrically connected without any intervening transistors" or "electrically connected through no intervening transistors".

FIG. 1 is a schematic diagram that illustrates a display device, e.g., an organic light emitting display device, according to an embodiment. The organic light emitting display device includes a display panel 100, a display panel driver 200, and a power source supplier 300.

The display panel 100 includes pixels P(1,1) to P(m,n) (m and n are positive integers of no less than 2), first power source supply lines VDDL1-1 to VDDL1-*m* (hereinafter, referred to as VDDL1) for transmitting a first power source voltage Vs1 (i.e., first power supply voltage Vs1) to the pixels P(1,1) to P(m,n) (hereinafter, referred to as P), second power source supply lines VDDL2-1 to VDDL2-*m* (hereinafter, referred to as VDDL2) for transmitting a second power source voltage Vs2 (i.e., second power supply voltage Vs2) to the pixels P, data lines D1 to Dn (hereinafter, referred to as D) for transmitting data voltages to the pixels P, and scan lines S1 to Sm (hereinafter, referred to as S) for transmitting scan signals to the pixels P. A pixel P(a,b) (a is a positive integer of no more than m, and b is a positive integer of no more than n) is electrically connected to a scan line Sa, a first power source supply line VDDL1-*a*, a second power source supply line VDDL2-*a*, and a data line Db. The display panel 100 may include first sensing lines, second sensing lines, and sensing signal supply lines, which are described with reference to FIG. 2.

The display panel driver 200 drives the display panel 100 by generating the data voltages and supplying the generated data voltages to the data lines D and by generating the scan signals and supplying the generated scan signals to the scan lines S. Specifically, the display panel driver 200 includes a host 210, a timing controller 220, a data driver 230, and a scan driver 240. The host 210, the timing controller 220, the data driver 230, and the scan driver 240 may be respectively implemented by electronic devices or the entire display panel driver 200 may be implemented by one electronic device (for example, a display driving integrated circuit (IC), etc.).

The host 210 receives an electrical signal corresponding to a screen to be displayed from the outside and provides the received electrical signal to the timing controller 220. Image data input from an external video source device may be converted into a data format of resolution suitable for displaying the image data on the display panel 100. The host 210 supplies a vertical synchronizing signal Vsync, a horizontal synchronizing signal Hsync, a data enable signal DE, and a dot clock CLK as well as image data RGB to the timing controller 220 through interface such as low voltage differential signaling (LVDS) interface and transition minimized differential signaling (TMDS) interface.

The timing controller 220 receives the vertical synchronizing signal Vsync, the horizontal synchronizing signal Hsync, the data enable signal DE, and the dot clock CLK from the host 210 and generates timing control signals for controlling operation timing of the data driver 230 and the scan driver 240. The timing control signals includes a scan timing control signal SCS for controlling the operation timing of the scan driver 240 and a data timing control signal DCS for controlling the operation timing of the data driver 230 and a data voltage. The data timing control signal DCS controls data sampling start timing of the data driver 230. In addition, the data timing control signal DCS outputs the image data RGB to the data driver 230 so that the display panel 100 may display an image.

The data driver 230 latches the image data RGB input from the timing controller 220 in response to the data timing control signal DCS. The data driver 230 includes a plurality of source drive ICs. The source drive ICs may be electrically connected to the data lines D of the display panel 100 by a chip on glass (COG) process or a tape automated bonding (TAB) process.

The scan driver 240 sequentially applies the scan signals to the scan lines S in response to the scan timing control signal SCS. The scan driver 240 is directly formed on a substrate of the display panel 100 in a gate in panel (GIP) method or may be electrically connected to the scan lines S of the display panel 100 in the TAB method.

The power source supplier 300 generates the first power source voltage Vs1 and the second power source voltage Vs2, supplies the first power source Vs1 to the first power source supply lines VDDL1, and supplies the second power source Vs2 to the second power source supply lines VDDL2. The first power source Vs1 and the second power source Vs2 may have different voltage levels in accordance with time. Timings at which the voltage levels change may be controlled by a signal (not shown) from the display panel driver 200.

Figure 2:
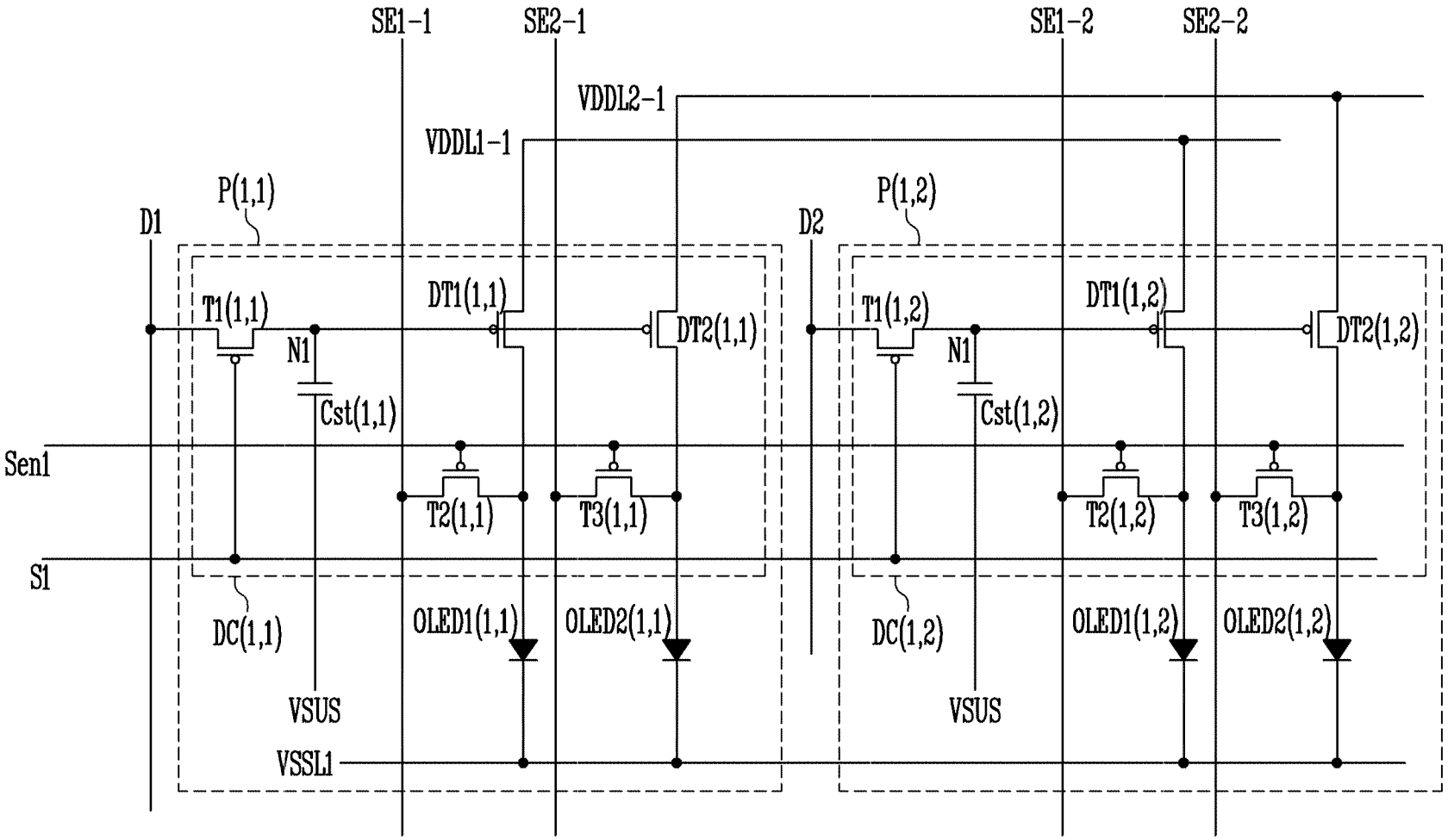
FIG. 2 is a schematic diagram that illustrates elements of pixels of the display device of FIG. 1 according to an embodiment.

FIG. 2 is a schematic diagram that illustrates elements of pixels of the display device of FIG. 1 according to an embodiment. In an embodiment, among all the pixels P, the first pixel P(1,1) and a second pixel P(1,2) adjacent to the first pixel P(1,1) are described as examples. The display device may include first sensing lines, second sensing lines, and sensing signal supply lines that include first sensing lines SE1-1 and SE1-2, second sensing lines SE2-1 and SE2-2, and a sensing signal supply line Sen1 illustrated in FIG. 2. It is noted that a pixel P(a,b) of the display device is electrically connected to a first sensing line SE1-*b*, a second sensing line SE2-*b*, and a sensing signal supply line Sena.

The first pixel P(1,1) includes a driving circuit DC(1,1), a first light emitting diode (e.g., a first organic light emitting diode OLED1(1,1)), and a second light emitting diode (e.g., a second organic light emitting diode OLED2(1,1)). The second pixel P(1,2) includes a driving circuit DC(1,2), first light emitting diode (e.g., a first organic light emitting diode OLED1(1,2)), and second light emitting diode (e.g., a second organic light emitting diode OLED2(1,2)).

The driving circuit DC(1,1) includes a first driving transistor DT1(1,1), a second driving transistor DT2(1,1), a first transistor T1(1,1) (i.e., a first data transistor), a second transistor T2(1,1) (i.e., a first sensing transistor), a third transistor T3(1,1) (i.e., a second sensing transistor), and a storage capacitor Cst(1,1).

A first electrode of the first driving transistor DT1(1,1) is electrically connected to the first power source supply line VDDL1-1, a second electrode thereof is electrically connected to an anode of the first organic light emitting diode OLED1(1,1), and a gate electrode thereof is electrically connected to a first node N1. The first electrode of the first driving transistor DT1(1,1) may be one of a source electrode and a drain electrode and the second electrode thereof may be the other one of the source electrode and the drain electrode. In an embodiment, the first electrode of the first driving transistor DT1(1,1) may be the source electrode, and the second electrode thereof may be the drain electrode. In accordance with a transistor, a first electrode can be one of a source electrode and a drain electrode, and a second electrode can be the other of the source electrode and the drain electrode.

A first electrode of the second driving transistor DT2(1,1) is electrically connected to the second power source supply line VDDL2-1, a second electrode thereof is electrically connected to an anode of the second organic light emitting diode OLED2(1,1), and a gate electrode thereof is electrically connected to the first node N1.

A first electrode of the first transistor T1(1,1) is electrically connected to a data line D1, a second electrode thereof is electrically connected to the first node N1, and a gate electrode thereof is electrically connected to a scan line S1.

A first electrode of the second transistor T2(1,1) is electrically connected to the anode of the first organic light emitting diode OLED1(1,1), a second electrode thereof is electrically connected to the first sensing line SE1-1, and a gate electrode thereof is electrically connected to the sensing signal supply line Sen1.

A first electrode of the third transistor T3(1,1) is electrically connected to the anode of the second organic light emitting diode OLED2(1,1), a second electrode thereof is electrically connected to the second sensing line SE2-1, and a gate electrode thereof is electrically connected to the sensing signal supply line Sen1. The second transistor T2(1,1) and the third transistor T3(1,1) are for external compensation. In an embodiment, a different compensating method may be implemented, and the second transistor T2(1,1) and the third transistor T3(1,1) may be unnecessary.

One end of the storage capacitor Cst(1,1) is electrically connected to the first node N1 and a sustain voltage VSUS is supplied to the other end of the storage capacitor Cst(1,1). The sustain voltage VSUS may have a first level V1. In an embodiment, the first level V1 is sufficiently higher than a level of a voltage supplied to third power source supply line VSSL1, or third voltage supply line VSSL1, which may provide a ground voltage.

The anode of the first organic light emitting diode OLED1(1,1) is electrically connected to the second electrode of the first driving transistor DT1(1,1) and a cathode thereof is electrically connected to the third power source supply line VSSL1. In an embodiment, the voltage supplied to the third power source supply line VSSL1 has a level of no more than 0 V.

The anode of the second organic light emitting diode OLED2(1,1) is electrically connected to the second electrode of the second driving transistor DT2(1,1) and a cathode thereof is electrically connected to the third power source supply line VSSL1.

The second pixel P(1,2) is analogous to the first pixel P(1,1).

The first organic light emitting diode OLED1(1,1) of the first pixel P(1,1) emits first light having a first wavelength. The first organic light emitting diode OLED1(1,2) of the second pixel P(1,2) emits second light having a second wavelength. The second organic light emitting diode OLED2(1,1) of the first pixel P(1,1) and the second organic light emitting diode OLED2(1,2) of the second pixel P(1,2) emits third light having a third wavelength. Here, the color of the first light and the color of the third light do not complement each other, and the color of the second light and the color of the third light may not complement each other. The sum of two of the three colors of the first light, the second light, and the third light may complement the remaining one of the three colors. For example, the first light is red light, the second light is green light, and the third light may be blue light. In this case, since the sum of the first light and the second light is yellow light, the sum of the color of the first light and the color of the second light may complement the color of the third light. In an embodiment, the second wavelength is shorter than the first wavelength and is longer than the third wavelength. In an embodiment, the first light is a red light, the second light is a blue light, and the third light may be a green light. In an embodiment, the first light is a green light, the second light is a blue light, and the third light is a red light, such that the sum of the color of the first light and the color of the second light is a yellow light, and such that the sum of the color of the first light and the color of the second light may complement the color of the third light.

The first organic light emitting diode OLED1(1,1) is electrically connected to the first power source supply line VDDL1-1, and the second organic light emitting diode OLED2(1,1) is electrically connected to the second power source supply line VDDL2-1. When a voltage level of the first power source Vs1 is higher than the level of the voltage supplied to the third power source supply line VSSL1, the first organic light emitting diode OLED1(1,1) may emit light by a current that flows through the first electrode and the second electrode of the first driving transistor DT1(1,1). For example, when the voltage level of the first power source Vs1 is a first level (for example, no less than 5 V) and the level of the voltage supplied to the third power source supply line VSSL1 is no more than 0 V, a current from the first power source supply line VDDL1-1 reaches the third power source supply line VSSL1 through the first driving transistor DT1(1,1) and the first organic light emitting diode OLED1(1,1). A level of the current that flows through the first organic light emitting diode OLED1(1,1) and brightness of the light emitted by the first organic light emitting diode OLED1(1,1) may be determined by a difference in voltage level between the first node N1 and the first power source Vs1. When the voltage level of the first power source Vs1 is no more than the level of the voltage supplied to the third power source supply line VSSL1, since the current does not flow from the first power source supply line VDDL1-1 to the third power source supply line VSSL1, the first organic light emitting diode OLED1(1,1) does not emit light. Like the first power source Vs1, when the voltage level of the second power source Vs2 is higher than the level of the voltage supplied to the third power source supply line VSSL1, the second organic light emitting diode OLED2(1,1) may emit light by a current that flows through the first electrode and the second electrode of the second driving transistor DT2(1,1). For example, when the voltage level of the second power source Vs2 is a first level (for example, no less than 5 V) and the level of the voltage supplied to the third power source supply line VSSL1 is no more than 0 V, a current from the second power source supply line VDDL2-1 reaches the third power source supply line VSSL1 through the second driving transistor DT2(1,1) and the second organic light emitting diode OLED2(1,1). When the voltage level of the second power source Vs2 is no more than the level of the voltage supplied to the third power source supply line VSSL1, since the current does not flow from the second power source supply line VDDL2-1 to the third power source supply line VSSL1, the second organic light emitting diode OLED2(1,1) does not emit light. Light emissions of the first organic light emitting diodes OLED1(1,1) and OLED1(1,2) and the second organic light emitting diodes OLED2(1,1) and OLED2(1,2) will be described in detail with reference to FIG. 3.

In order to implement a display panel of high resolution, it is desirable to reduce an area of a driving circuit for driving organic light emitting diodes. For this purpose, a method of adding transistors between one driving circuit and a plurality of organic light emitting diodes so that the plurality of organic light emitting diodes are driven by the driving circuit at different times was suggested. However, in the method, the transistors are added to the driving circuit so that an area of a pixel circuit increases and, since one pixel circuit sequentially emits red (R) light, green (G) light, and blue (B) light in one frame period, color break-up (CBU) occurs. It is known that the CBU occurs since red (R), green (G), and blue (B) are focused on different optic nerves at different times. However, in a pixel circuit structure according to the present invention, since a voltage of a power source line changes so that the plurality of organic light emitting diodes are driven at different times, the number of transistors in a pixel is reduced so that the area of the pixel circuit is reduced. In addition, in the frame period, since the yellow (Y) light that is the sum of the red (R) light and the green (G) light is emitted and then, the blue (B) light that complements the yellow (Y) light is emitted, the CBU is reduced.

Figure 3:
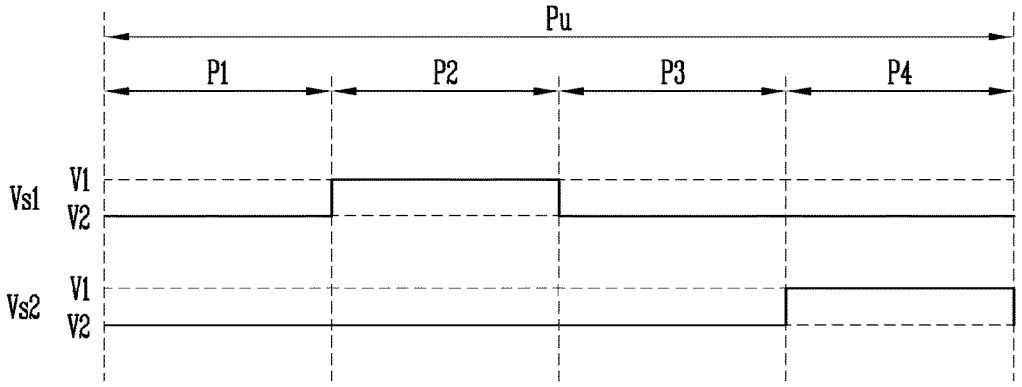
FIG. 3 is a schematic diagram that illustrates a method of driving the display device of FIG. 1 according to an embodiment.

FIG. 3 is a schematic diagram that illustrates a method of driving the display device of FIG. 1 according to an embodiment. Hereinafter, the method of driving the display device will be described with reference to FIGS. 1 to 3.

An entire period unit Pu includes a first period P1, a second period P2, a third period P3, and a fourth period P4. In the entire period unit Pu, the organic light emitting diodes OLED1(1,1), OLED1(1,2), OLED2(1,1), and OLED2(1,2) emit light components once. Here, the entire period unit Pu may be a one frame period. For example, when a driving frequency of the display panel 100 is 60 Hz, the entire period unit Pu may be 16.6 ms.

In the first period P1, the voltages of the first power source Vs1 and the second power source Vs2 have a second level V2. In an embodiment, the second level V2 is no more than the level of the voltage supplied to the third power source supply line VSSL1. Since the voltages of the first power source Vs1 and the second power source Vs2 are no more than the level of the voltage supplied to the third power source supply line VSSL1, the first organic light emitting diodes OLED1(1,1) and OLED1(1,2) and the second organic light emitting diodes OLED2(1,1) and OLED2(1,2) may be initialized without emitting light components. In at least a partial period of the first period P1, the second transistors T2(1,1) and T2(1,2) and the third transistors T3(1,1) and T3(1,2) are turned on by the sensing signal from the sensing signal supply line Sen1 and, when the second level V2 is supplied to the first sensing lines SE1-1 and SE1-2 and the second sensing lines SE2-1 and SE2-2, the first organic light emitting diodes OLED1(1,1) and OLED1(1,2) and the second OLEDs OLED2(1,1) and OLED2(1,2) may be initialized. After the organic light emitting diodes OLED1(1,1), OLED1(1,2), OLED2(1,1), and OLED2(1,2) have been initialized, the first data transistors T1(1,1) and T1(1,2) are turned on in response to (copies of) the scan signal transmitted by the scan line S1, such that the data voltages from the data lines D1 and D2 are supplied to gate electrodes of the driving transistors DT1(1,1), DT1(1,2), DT2(1,1), and DT2(1,2). After the data voltages from the data lines D1 and D2 have been supplied to the gate electrodes of the driving transistors DT1(1,1), DT1(1,2), DT2(1,1), and DT2(1,2), the sensing transistors T2(1,1), T2(1,2), T3(1,1), and T3(1,2) are turned on by (copies of) the sensing signal from the sensing signal supply line Sen1, such that such that the sensing lines SE1-1, SE1-2, SE2-1, and SE2-2 may respectively receive and transmit copies of driving voltages, wherein the driving voltages are respectively transmitted from the driving transistors DT1(1,1), DT1(1,2), DT2(1,1), and DT2(1,2) to the anodes of the organic light emitting diodes OLED1(1,1), OLED1(1,2), OLED2(1,1), and OLED2(1,2). The threshold voltages of the driving transistors DT1(1,1), DT1(1,2), DT2(1,1), and DT2(1,2) may be determined based on the data voltages and the copies of the driving voltages. Based on the threshold voltages of the driving transistors DT1(1,1), DT1(1,2), DT2(1,1), and DT2(1,2) and/or the sensing of the copies of the driving voltages, the timing controller 220 or the data driver 230 may compensate for the data voltages supplied to the data lines D1 and D2.

In the second period P2, the voltage of the first power source Vs1 has the first level V1, and the voltage of the second power source Vs2 has the second level V2. The organic light emitting diodes OLED1(1,1) and OLED1(1,2) emit light components, and the organic light emitting diodes OLED2(1,1) and OLED2(1,2) do not emit light components. The organic light emitting diode OLED1(1,1) emits the first light having the first wavelength, and the organic light emitting diode OLED1(1,2) emits the second light having the second wavelength. For example, when the first light is red and the second light is green, the sum of the first light and the second light may be a yellow light.

In the third period P3, the voltages of the first power source Vs1 and the second power source Vs2 have the second level V2. The organic light emitting diodes OLED1(1,1), OLED1(1,2), OLED2(1,1) and OLED2(1,2) may be initialized. Data voltages corresponding to the organic light emitting diodes OLED1(1,1), OLED1(1,2), OLED2(1,1), and OLED2(1,2) may be supplied to the gate electrodes of the driving transistors DT1(1,1), DT1(1,2), DT2(1,1), and DT2(1,2). Copies of the voltages received by the organic light emitting diodes OLED1(1,1), OLED1(1,2), OLED2(1,1), and OLED2(1,2) may be transmitted by the sensing lines SE1-1, SE1-2, SE2-1, and SE2-2 for the timing controller 220 or the data driver 230 to compensate the data voltages supplied to the data lines D1 and D2. Operation in the third period P3 may be substantially identical to or analogous to that in the first period P1.

In the fourth period P4, the voltage of the first power source Vs1 has the second level V2, and the voltage of the second power source Vs2 has the first level V1. The organic light emitting diodes OLED2(1,1) and OLED2(1,2) emit light components, and the organic light emitting diodes OLED1(1,1) and OLED1(1,2) do not emit light components. The organic light emitting diodes OLED2(1,1) and OLED2(1,2) emit the third light components having the third wavelength. For example, when the third light is blue, the blue light may be shown in the fourth period P4. That is, the light emitted in the second period P2 and the light emitted in the fourth period P4 may complement each other.

Since the organic light emitting diodes OLED1(1,1) and OLED1(1,2) emit light components only in the second period P2, and since the organic light emitting diodes OLED2(1,1) and OLED2(1,2) emit light components only in the fourth period P4, a period in which the organic light emitting diode OLED1(1,1) emits light does not overlap a period in which the organic light emitting diode OLED2(1,1) emits light.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope set forth in the following claims.

What is claimed is:

1. A pixel comprising:

a first organic light emitting diode configured to emit first light having a first wavelength;

a second organic light emitting diode configured to emit second light having a second wavelength different from the first wavelength;

a first driving transistor having a first electrode electrically connected to a first power source supply line, having a second electrode electrically connected to an anode of the first organic light emitting diode, and having a gate electrode directly connected to a first node;

a second driving transistor having a first electrode electrically connected to a second power source supply line, having a second electrode electrically connected to an anode of the second organic light emitting diode, and having a gate electrode directly connected to the first node;

a first transistor having a first electrode electrically connected to a data line, having a second electrode electrically connected to the first node, and having a gate electrode electrically connected to a scan line; and a storage capacitor having one end electrically connected to the first node and having other end to which a sustain voltage is supplied, wherein a period in which the first organic light emitting diode emits light does not overlap a period in which the second organic light emitting diode emits light.

2. The pixel of claim 1, wherein cathodes of the first organic light emitting diode and the second organic light emitting diode are electrically connected to third power source supply line, wherein the first organic light emitting diode emits light when a level of a voltage supplied to the first power source supply line is a first level and the second organic light emitting diode emits light only when a level of a voltage supplied to the second power source supply line is the first level, and wherein the first level is higher than a level of a voltage supplied to the third power source supply line.

3. The pixel of claim 1, wherein the first light and the second light do not complement each other.

4. The pixel of claim 1, further comprising:

a second transistor having a first electrode electrically connected to the anode of the first organic light emitting diode, having a second electrode electrically connected to a first sensing line, and having a gate electrode electrically connected to a sensing signal supply line; and a third transistor having a first electrode electrically connected to the anode of the second organic light emitting diode, having a second electrode electrically connected to a second sensing line, and having a gate electrode electrically connected to the sensing signal supply line.

5. An organic light emitting display device comprising:

a display panel including pixels, first power source supply lines configured to transmit a first power source to the pixels, second power source supply lines configured to transmit a second power source to the pixels, data lines configured to transmit data voltages to the pixels, and scan lines configured to transmit scan signals to the pixels;

a display panel driver configured to drive the display panel by generating the data voltages and supplying the generated data voltages to the data lines and by generating the scan signals and supplying the generated scan signals to the scan lines; and a power source supplier configured to generate the first power source and the second power source and to supply the generated first and second power sources to the first power source supply lines and the second power source supply lines, respectively, wherein each pixel comprises:

a first organic light emitting diode;

a second organic light emitting diode;

a first driving transistor having a first electrode electrically connected to one of the first power source supply lines, having a second electrode electrically connected to an anode of the first organic light emitting diode, and having a gate electrode directly connected to a first node;

a second driving transistor having a first electrode electrically connected to one of the second power source supply lines, having a second electrode electrically connected to an anode of the second organic light emitting diode, and having a gate electrode directly connected to the first node;

a first transistor having a first electrode electrically connected to one of the data lines, having a second electrode electrically connected to the first node, and having a gate electrode electrically connected to one of the scan lines; and a storage capacitor having one end electrically connected to the first node and having other end to which a sustain voltage is supplied, wherein cathodes of the first organic light emitting diode and the second organic light emitting diode are electrically connected to third power source supply line, and wherein a period in which the first organic light emitting diode emits light does not overlap a period in which the second organic light emitting diode emits light.

6. The organic light emitting display device of claim 5, wherein the pixels comprise a first pixel and a second pixel adjacent to the first pixel, wherein a first organic light emitting diode of the first pixel emits first light having a first wavelength, wherein a first organic light emitting diode of the second pixel emits second light having a second wavelength different from the first wavelength, and wherein second organic light emitting diode of the first pixel and the second pixel emit third light components having a third wavelength different from the first wavelength and the second wavelength.

7. The organic light emitting display device of claim 6, wherein the sum of the first light and the second light complements the third light.

8. The organic light emitting display device of claim 7, wherein the second wavelength is shorter than the first wavelength and is longer than the third wavelength.

9. The organic light emitting display device of claim 5, wherein the organic light emitting display device further comprises first sensing lines, second sensing lines, and sensing signal supply lines, wherein each pixel further comprises:

a second transistor having a first electrode electrically connected to the anode of the first organic light emitting diode, having a second electrode electrically connected to one of the first sensing lines, and having a gate electrode electrically connected to one of the sensing signal supply lines; and a third transistor having a first electrode electrically connected to the anode of the second organic light emitting diode, having a second electrode electrically connected to one of the second sensing lines, and having a gate electrode electrically connected to one of the sensing signal supply lines.

10. A method of driving an organic light emitting display device comprising:

a display panel including pixels, first power source supply lines configured to transmit a first power source to the pixels, second power source supply lines configured to transmit a second power source to the pixels, data lines configured to transmit data voltages to the pixels, and scan lines configured to transmit scan signals to the pixels;

a display panel driver configured to drive the display panel by generating the data voltages and supplying the generated data voltages to the data lines and by generating the scan signals and supplying the generated scan signals to the scan lines; and a power source supplier configured to generate the first power source and the second power source and to supply the generated first and second power sources to the first power source supply lines and the second power source supply lines, respectively, wherein each pixel comprises:

a first organic light emitting diode;

a second organic light emitting diode;

a first driving transistor having a first electrode electrically connected to one of the first power source supply lines, having a second electrode electrically connected to an anode of the first organic light emitting diode, and having a gate electrode directly connected to a first node;

a second driving transistor having a first electrode electrically connected to one of the second power source supply lines, having a second electrode electrically connected to an anode of the second organic light emitting diode, and having a gate electrode directly connected to the first node;

a first transistor having a first electrode electrically connected to one of the data lines, having a second electrode electrically connected to the first node, and having a gate electrode electrically connected to one of the scan lines; and a storage capacitor having one end electrically connected to the first node and having other end to which a sustain voltage is supplied, and wherein the method comprises:

supplying first data voltages corresponding to the first organic light emitting diodes among the data voltages to the first nodes;

setting a voltage level of the first power source as a first level so that the first organic light emitting diodes emit light components;

supplying second data voltages corresponding to the second organic light emitting diodes among the data voltages to the first nodes; and setting a voltage level of the second power source as the first level so that the second organic light emitting diodes emit light components.

11. The method of claim 10, wherein, in the supplying of first data voltages corresponding to the first organic light emitting diodes among the data voltages to the first nodes, the first node is initialized and a threshold voltage of the first driving transistor is compensated for, and wherein, in the supplying of second data voltages corresponding to the second organic light emitting diodes among the data voltages to the first nodes, the first node is initialized and a threshold voltage of the second driving transistor is compensated for.

12. The method of claim 10, wherein the pixels comprise a first pixel and a second pixel adjacent to the first pixel, wherein, in the setting of a voltage level of the first power source as a first level so that the first organic light emitting diodes emit light components, a first organic light emitting diode of the first pixel emits first light having a first wavelength and a first organic light emitting diode of the second pixel emits second light having a second wavelength different from the first wavelength, wherein, in the setting of a voltage level of the second power source as the first level so that the second organic light emitting diodes emit light components, second organic light emitting diodes of the first pixel and the second pixel emit third light components having a third wavelength different from the first wavelength and the second wavelength, and wherein the sum of the first light and the second light can complement the third light.

13. The method of claim 12, wherein the second wavelength is shorter than the first wavelength and is longer than the third wavelength.

14. The method of claim 10, wherein the organic light emitting display device further comprises first sensing lines, second sensing lines, and sensing signal supply lines, wherein each pixel further comprises:

a second transistor having a first electrode electrically connected to the anode of the first organic light emitting diode, having a second electrode electrically connected to one of the first sensing lines, and having a gate electrode electrically connected to one of the sensing signal supply line; and a third transistor having a first electrode electrically connected to the anode of the second organic light emitting diode, having a second electrode electrically connected to one of the second sensing lines, and having a gate electrode electrically connected to one of the sensing signal supply lines, and wherein, in at least a part of the supplying of first data voltages corresponding to the first organic light emitting diodes among the data voltages to the first nodes and the supplying of second data voltages corresponding to the second organic light emitting diodes among the data voltages to the first nodes, at least one of the second transistor and the third transistor is turned on.

* * * * *